US006050322A

United States Patent [19]

Finkelstein et al.

[11] Patent Number: 6,050,322

[45] **Date of Patent: *Apr. 18, 2000**

[54] STRIP CURTAIN

[75] Inventors: Burl Finkelstein; Mark Kennedy, both of Newnan, Ga.

[73] Assignee: Kason Industries, Inc., Shenandoah, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/912,820

[22] Filed: Aug. 19, 1997

[51] Int. Cl.[7] ..... A47H 1/00

[52] U.S. Cl. ..... 160/332; 160/178.1; 160/184; 160/330

[58] Field of Search ..... 160/184, 332, 160/380, 196.1, 404, 178.1 V; 312/116

[56] References Cited

U.S. PATENT DOCUMENTS

| | | | |
|---|---|---|---|
| 3,231,007 | 1/1966 | Kerr | 160/332 |
| 3,809,144 | 5/1974 | Garufo | 160/184 |
| 4,289,190 | 9/1981 | Catan | 169/332 |
| 4,312,396 | 1/1982 | McKinnon | 160/332 |
| 4,335,777 | 6/1982 | Simon | 160/332 |
| 4,449,270 | 5/1984 | Brabant | 16/87.4 |
| 4,515,202 | 5/1985 | Wilson | 160/332 |
| 4,887,659 | 12/1989 | West | 160/196.1 X |
| 5,127,460 | 7/1992 | Abadi et al. | 160/332 |
| 5,146,971 | 9/1992 | McCarty | 160/184 |
| 5,520,237 | 5/1996 | Finkelstein et al. | 160/184 |
| 5,645,330 | 7/1997 | Artwohl et al. | 312/116 |

FOREIGN PATENT DOCUMENTS

| | | |
|---|---|---|
| 1229987 | 3/1960 | France . |
| 2054712 | 2/1981 | United Kingdom . |

*Primary Examiner*—Daniel P. Stodola
*Assistant Examiner*—Bruce A. Lev
*Attorney, Agent, or Firm*—Kennedy, Davis & Hodge LLP

[57] ABSTRACT

A strip curtain system has an elongated track (10) that has a back side (11) with a bottom flange rail (14) and a front side (12) with a bottom flange rail (14) providing a channel 15. The track back side has a ridge (17) extending above at least a portion of the back side bottom flange. The track front side has a channel access port 22 located in front of the back side ridge. A number of curtain strips (30) have a bifurcated hanger (31) mounted about opposite sides their top ends. The bifurcated hangers have a bottom (37) shaped to be slidably supported upon the track rails and a hang support surface (38) for support upon the track back side ridge.

6 Claims, 3 Drawing Sheets

STRIP CURTAIN

TECHNICAL FIELD

This invention relates generally to strip curtains, and particularly to heavy duty strip curtains such as those used in truck loading docks, warehouses and the like.

BACKGROUND OF THE INVENTION

Strip curtains are used to minimize the passage of air, light, dust, noise, smoke and the like through a doorway without blocking persons and equipment from passing through. They are often located in commercial environments where there is a high traffic flow of persons, equipment and supplies through a passageway. The smaller strip curtains typically have multiple strips of plastic or vinyl hung side by side from hangers mounted in a track. Access to the track for loading the hangers is gained from its two ends. Once inserted into an end of the track the hangers are slid in the track channel until the curtain is fully formed with main body portions of the curtain strips depending from the hangers side by side and often overlapping one another to some extent. In this manner a spreadable barrier is formed that restricts the flow of air, light, dust, and the like through the passageway while yet permitting people and equipment to pass by momentarily spreading the curtain strips apart.

Over time contact by equipment wears and damages the curtain strips leading to a need to replace individual strips. Replacement of the individual strips however is tedious. Typically it is the central portion of the curtain that takes the most beating and wears the most. Thus in order to replace a single strip, all of the other strips between it and an access end of the track must also be removed and replaced even though they are not damaged.

Larger strip curtains, such as those used in warehouses and loading docks, usually do not have their curtain strips mounted in tracks because their weight would tend to tear them loose from their hangers, to which they are secured by pegs, as when forklifts and other heavy equipment engage them. Instead, they typically have their strips top ends bolted to an angle iron by a number of bolts and wing nuts. Although individual strips may be replaced in this type curtain without temporary replacement of undamaged strips, they are nevertheless relatively tedious and cumbersome to replace. Their replacement requires the extraction and replacement of many bolts through holes in the top ends of the heavy strips rather than the mere sliding of a hanger along a track.

Accordingly, it is seen that a need remains for a strip curtain that may have heavy, quite sizable strips and yet which possesses the ability to have its individual strips replaced with relative ease.

SUMMARY OF THE INVENTION

In a preferred form of the invention a strip curtain system comprises an elongated track having a back side with a bottom flange rail and a front side with a bottom flange rail providing a channel. The track back side has a ridge extending above at least a portion of the back side bottom flange. The front side has a channel access port located in front of the back side ridge. A number of curtain strips are provided that have a bifurcated hanger having two plates mounted about opposite sides of a top end of the curtain strip. The bifurcated hanger has a V-shaped bottom shaped to be slidably supported upon the track rails and an overhanging support surface adapted to be supported upon the track back side ridge behind the access port. The system also has a cover for the track access port that also has a bottom flange rail. With this construction individual strips may be loaded and unloaded through the front side of the track rather than from a track end. The V-shaped track rails support the V-shaped bottoms of the hanger so as to press the two hanger plates towards one another and the curtain strip thereby insuring that the heavy strip does not tear loose from its hanger.

DETAILED DESCRIPTION

Figure 1:
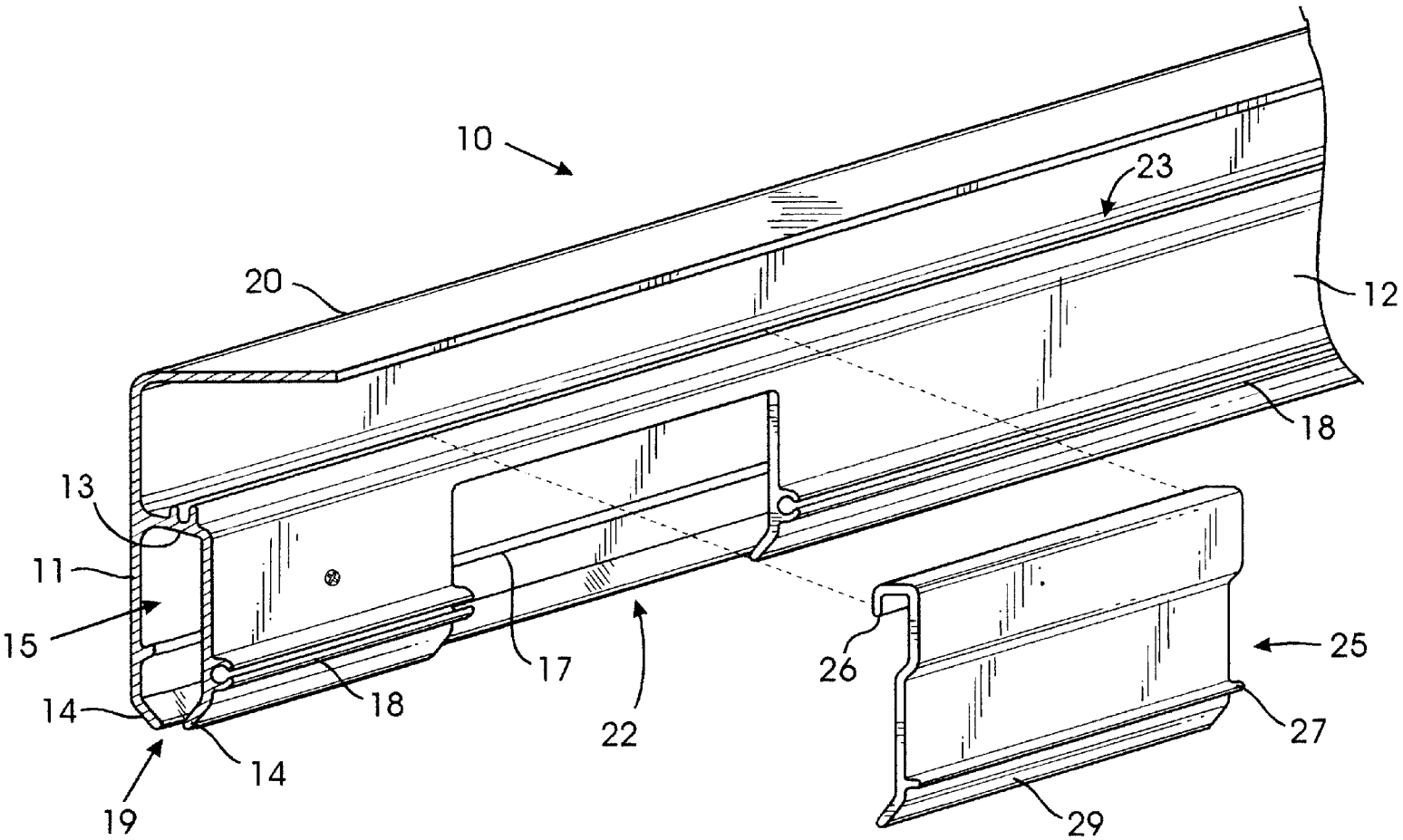
FIG. 1 is a perspective view of a portion of the track of a strip curtain system in accordance with a preferred embodiment of the invention.

With reference to FIG. 1, there is shown a unitary, extruded, elongated metallic track 10 of the strip curtain system that has a back side 11, a front side 12, a top or dome 13 and a flanged rail 14 at the bottom of each side. A channel 15 is thus formed bounded by the back side 11, the front side 12, above the bottom flange rails 14 and below the top 13. A ridge 17 extends inwardly from the back side 11. A slot 18 extends along the outside of the front side 12. The two flanged rails are canted at an acute angle with respect to the sides 11 and 12 in a collective V-shape with their lower ends spaced slightly apart to form an elongated slot-like opening 19 in the bottom of the channel 15. An L-shaped mounting bracket 20 is unitarily formed as an upward extension of the back side 11. It has unshown mounting holes for mounting as with bolts to the top of a passageway.

The front side 12 of the track has a channel access port 22 located opposite the ridge 17 on the back side 11. Preferably such a port is formed near each of the track. Larger tracks preferably have a series of these access ports. A raised groove 23 extends the length of the track top 13. A cover 25 is hingedly mounted by a hook portion 26 in this raised groove 23 over the access port. The cover also has a lip 27 and a canted flange rail 29.

Figure 2:
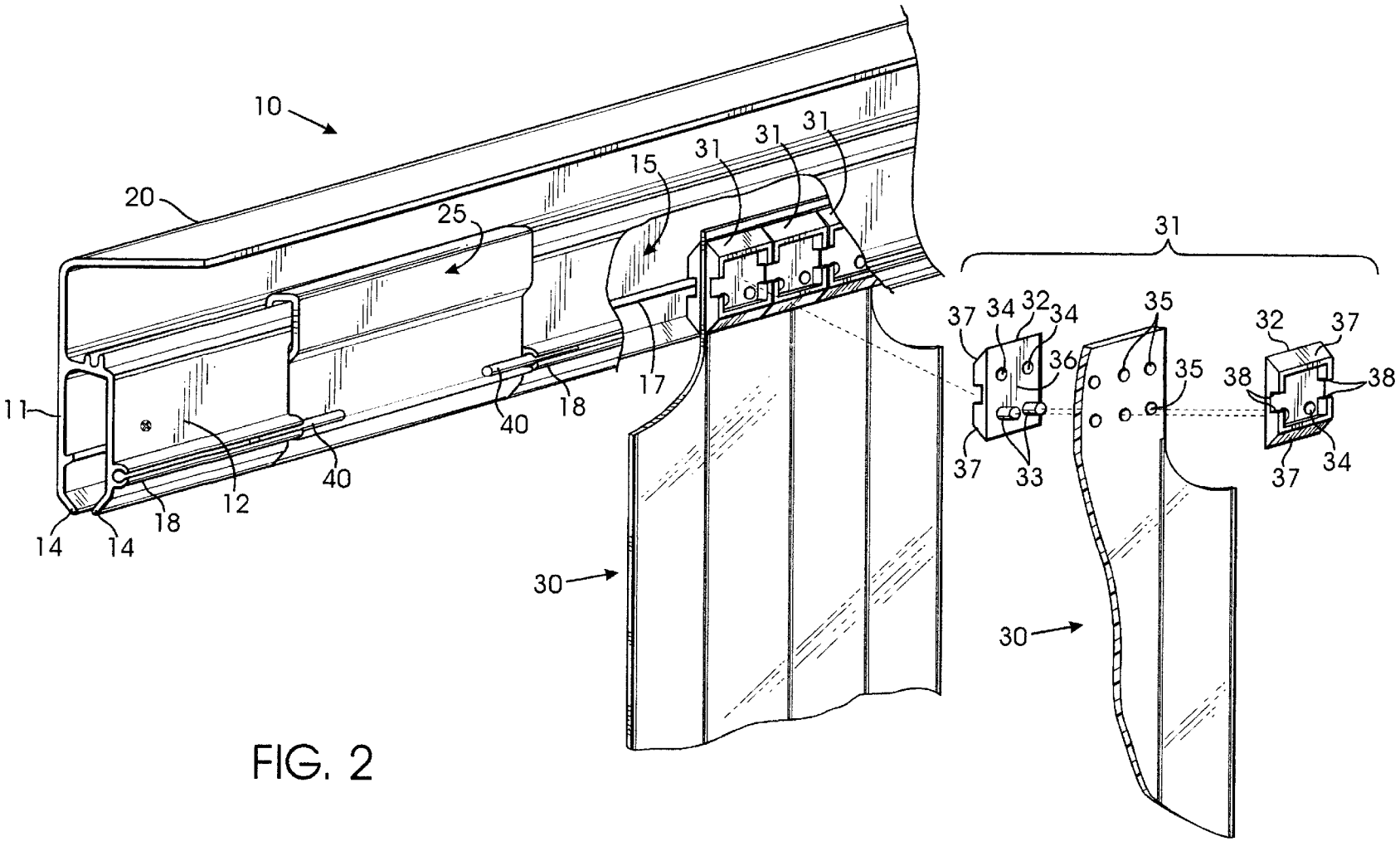
FIG. 2 is a perspective view of the track of FIG. 1 which a segment of the track cut away to show a single curtain strip hanging from the track and an exploded view of a hanger from which the curtain strip depends.

With reference to FIG. 2, a single curtain strip 30 out of a set of strips is shown hanging from three hangers 31 that are slidably mounted in the track channel 15 upon the flanged rails 14. Each hanger is comprised of two plates 32 of identical construction. Each hanger plate has a flat face 36 and two flat bearing ends 37 that extend at an acute angle from opposite ends of the face. Each also has four back side ledges 38. Each plate here further has two pegs 33 and two peg holes 34. The hangers are mounted to the curtain strips by inverting one of the mating plates with respect to the other and passing their pegs 33 through the holes 35 in the top portion of the curtain strip 30 and into the holes 34 of the opposite hanger plate. Multiple hangers may be attached to a single curtain strip, as shown in FIG. 2.

Once mounted in the track 33 the weight of the curtain strip 30, which passes through the opening 19 in the bottom of the track, is transferred to the hangers and against the flanged rails of the track. Since the flanged rails converge against the V-shaped bottoms of the hangers, the weight of the curtain strip serves to force the two hanger plates together against the curtain strip. As a result the weight force acting on the hanger causes it to grip the curtain strip rather than tend to separate or rip the strip from its hanger.

Figure 5:
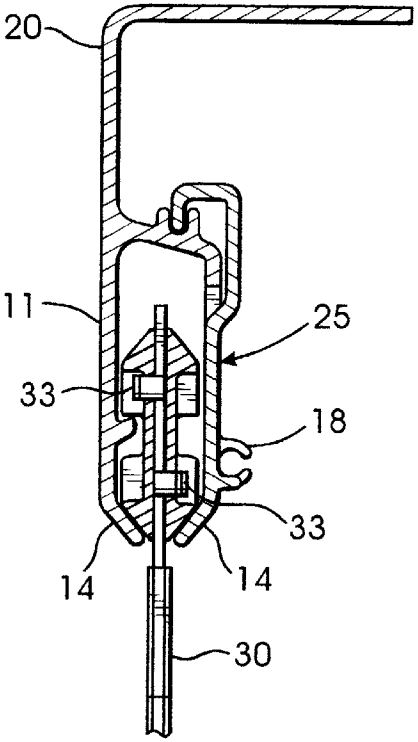
FIGS. 3, 4 and 5 are sectional views of the track of FIG. 1 sequentially showing a single curtain strip being loaded onto the system track.
Figure 4:
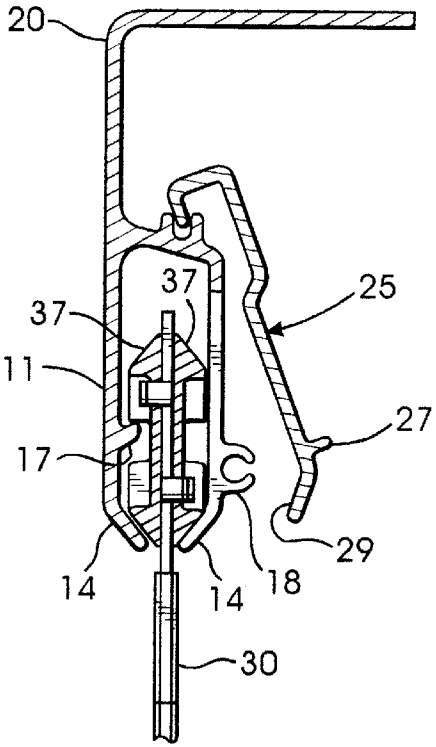
Figure 3:
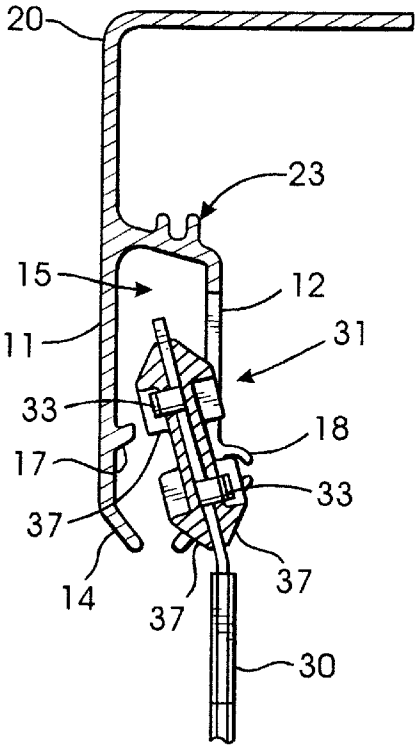

FIGS. 3–5 show how an individual strip curtain 30 is mounted in the channel 15 of the track 10. In FIG. 3 a hanger 31 is shown being inserted into the channel 15 through the access port 22 with the port cover 25 removed. The hanger is mounted against the track back side 11 with one of its overhanging ledges 38 supported upon the track back side ridge 17 and with one of its flat bearing surfaces 37 pressed against the flange rail 14 of the track back side. With the strip so mounted to the track back side the cover 25 is mounted, as shown being done in FIGS. 4 and 5, by seating its hook 26 in the raised groove 23 and swinging it into alignment with the track front side 12. Lock pins 40 are then slid in the front side slot 18 and over the cover lip 27. This locks the cover firmly in place as shown in FIG. 2. This also brings the flanged rail 29 of the cover against the other, exposed bearing surface 37 of the hanger causing the hanger to be lifted slightly off the rear wall ledge 17. The hanger may now be slid along the track beyond the channel access port to bring its supported curtain strip to a desired location. Alternatively, it may simply be left in place behind the cover.

It thus is seen that a strip curtain system is now provided that overcomes problems long associated with those of the prior art. That individual curtain strips may be front loaded instead of end loaded upon the track provides a distinct advantage. The construction of the hangers provides enhanced strength whereby the weight of the strips is profitably instead of adversely employed. Though the invention has been described and illustrated in its preferred form, it should be understood that many modifications, additions and deletions may be made thereto without departure from the spirit and scope of the invention as set forth in the following claims.

We claim:

1. A strip curtain system comprising an elongated track having an elongated back side with a bottom flange rail canted at an acute angle with respect to said back side and an elongated front side with a bottom flange rail canted at an acute angle with respect to said front side providing a channel, said track back side having a ridge extending above at least a portion of said back side bottom flange and said front side having a channel access port located in front of said back side ridge, the top of said ridge being accessible through said access port, a plurality of curtain strips and a plurality of bifurcated hangers mounted about opposite sides of top end portions of said curtain strips, and with said bifurcated hangers each having a bottom shaped to be slidably supported upon said track back side flange rail and said front side flange rail and a support surface for hanging support upon said track back side ridge upon being inserted into said track through said access port and wherein said track back side flange rail and said track front side flange rail converge downwardly along two opposed inclines to be collectively generally V-shaped.

2. The strip curtain system of claim 1 wherein each of said bifurcated hangers has a generally V-shaped bottom having flat bearing surfaces that converge along two opposed inclines.

3. A strip curtain track comprising an elongated back bottom back side with a bottom flange canted at an acute angle with respect to said back side and an elongated front side with a bottom flange canted at an acute angle with respect to said back side wherein said track back side bottom flange and said track front side bottom flange converge along two opposed inclines to be collectively generally V-shaped, and wherein said front side has an access opening through which hangers supporting curtain strips may be inserted into the track and mounted upon said back side support ridge and back side bottom flange prior to being slid down the track upon said back side bottom flange and front side bottom flange away from said access opening.

4. A hanger for a strip curtain comprising two plates of identical size and shape with each plate having a substantially flat side adapted to be mountable flush aside a top end portion of the curtain strip and opposed flat bearing ends that converge along two opposed inclines and that extend from opposite ends of said flat side at an acute angle, and means for fastening said two plates together about opposite side of the strip curtain whereby the weight of the strip curtain is exerted on the flat bearing ends in contact with the flanges and thereby pushes the flat sides toward one another compressively against the top end portion of the strip curtain.

5. The strip curtain hanger of claim 4 wherein said fastening means comprises a peg mounted to each of said plates.

6. The strip curtain hanger of claim 4 wherein each of said plates has a flat hanging support ridge located between said opposed flat ends.

* * * * *